US009565505B2

(12) United States Patent
Ronig et al.

(10) Patent No.: US 9,565,505 B2
(45) Date of Patent: Feb. 7, 2017

(54) LOUDSPEAKER CONE EXCURSION ESTIMATION USING REFERENCE SIGNAL

(71) Applicant: Intel IP Corporation, Santa Clara, CA (US)

(72) Inventors: Richard Ronig, Oberhausen (DE); Markus Hammes, Dinslaken (DE); Christian Kranz, Ratingen (DE)

(73) Assignee: INTEL IP CORPORATION, Santa Clara, CA (US)

( * ) Notice: Subject to any disclaimer, the term of this patent is extended or adjusted under 35 U.S.C. 154(b) by 0 days.

(21) Appl. No.: 14/742,397

(22) Filed: Jun. 17, 2015

(65) Prior Publication Data

US 2016/0373871 A1 Dec. 22, 2016

(51) Int. Cl.

| | |
|---|---|
| ***H04R 29/00*** | (2006.01) |
| ***H04R 3/00*** | (2006.01) |
| ***H04R 3/04*** | (2006.01) |

(52) U.S. Cl.

CPC ..... *H04R 29/003* (2013.01); *H04R 3/007* (2013.01); *H04R 3/04* (2013.01)

(58) Field of Classification Search

CPC ..... H04R 29/003; H04R 3/007; H04R 3/04

USPC ..... 29/594; 84/731; 340/407.1, 466; 379/406.1; 381/55, 59, 62, 73.1, 77, 96, 381/98, 102, 120, 190, 191, 331, 74, 399, 381/423; 455/575.1; 181/142, 156, 199; 330/251

See application file for complete search history.

(56) References Cited

U.S. PATENT DOCUMENTS

| | | | | |
|---|---|---|---|---|
| 4,113,983 | A * | 9/1978 | Steel | H03G 5/22 330/301 |
| 4,697,334 | A * | 10/1987 | Madsen | H04R 31/006 29/594 |
| 5,484,969 | A * | 1/1996 | McKendree | G10K 7/06 116/137 R |
| 5,548,650 | A * | 8/1996 | Clark | H04R 3/002 381/100 |
| 6,108,433 | A * | 8/2000 | Norris | G10K 9/13 367/140 |
| 6,646,507 | B1 * | 11/2003 | Prokin | H04R 9/063 330/207 A |
| 8,019,088 | B2 * | 9/2011 | Holman | H04R 3/08 381/55 |
| 8,967,323 | B1 * | 3/2015 | Grenier | H04R 1/403 181/198 |
| 2004/0052391 | A1 * | 3/2004 | Bren | H04R 25/43 381/331 |
| 2005/0025317 | A1 * | 2/2005 | Fedigan | H04R 9/063 381/59 |
| 2005/0046551 | A1 * | 3/2005 | Cranfill | B06B 1/0276 340/407.1 |
| 2005/0087392 | A1 * | 4/2005 | Flanders | H04R 1/2857 181/156 |
| 2005/0181841 | A1 * | 8/2005 | Dou | H04M 1/03 455/575.1 |

(Continued)

*Primary Examiner* — Gerald Gauthier

(74) *Attorney, Agent, or Firm* — Blakely, Sokoloff, Taylor & Zafman LLP

(57) ABSTRACT

The excursion of a loudspeaker cone is estimated using a reference signal in one example, a primary signal, produced by a cone of a loudspeaker, is received and a reference signal produced simultaneously with the primary signal by the loudspeaker cone is received. The reference signal causes an excursion of the loudspeaker cone that is amplitude modulated by the excursion caused by the primary signal. An amplitude modulation of the reference signal is determined and an excursion of the loudspeaker cone is determined using the determined amplitude modulation.

20 Claims, 7 Drawing Sheets

(56) References Cited

U.S. PATENT DOCUMENTS

2005/0207584 A1* 9/2005 Bright ..... H04R 3/007 381/59
2005/0281413 A1* 12/2005 Croft, III ..... H04B 5/0006 381/77
2006/0213358 A1* 9/2006 Motsenbocker ..... G10H 3/185 84/731
2006/0233404 A1* 10/2006 Croft ..... H04R 1/403 381/191
2006/0291667 A1* 12/2006 Watanabe ..... H04R 1/323 381/77
2010/0150392 A1* 6/2010 O'neill ..... H04R 9/022 381/423
2011/0044471 A1* 2/2011 Aarts ..... H04R 3/04 381/98
2011/0182435 A1* 7/2011 Gautama ..... H04R 3/007 381/55
2012/0230513 A1* 9/2012 Yoneda ..... H04R 3/02 381/96
2013/0106599 A1* 5/2013 Nakayama ..... B60Q 5/008 340/466
2013/0163787 A1* 6/2013 Moon ..... H03F 3/187 381/120
2013/0287203 A1* 10/2013 Hodges ..... H04M 9/082 379/406.01
2014/0241536 A1* 8/2014 Adams ..... H04R 29/003 381/59
2014/0341394 A1* 11/2014 Croft, III ..... H04R 1/2811 381/102
2015/0055790 A1* 2/2015 Kawakami ..... G10K 11/178 381/73.1
2015/0071451 A1* 3/2015 Moon ..... H04R 3/04 381/62
2015/0124982 A1* 5/2015 Berthelsen ..... H04R 29/001 381/59
2015/0131806 A1* 5/2015 Gautama ..... H04R 29/001 381/59
2015/0189427 A1* 7/2015 Tsai ..... H04R 3/007 381/190
2015/0208189 A1* 7/2015 Tsai ..... H04R 3/04 381/59
2015/0237443 A1* 8/2015 Ronig ..... H04R 3/007 381/55
2015/0249889 A1* 9/2015 Iyer ..... H04R 3/08 381/98
2015/0304774 A1* 10/2015 Ambrose ..... H04R 1/10 381/74
2016/0134982 A1* 5/2016 Iyer ..... H04R 29/001 381/59
2016/0157015 A1* 6/2016 Van Schyndel ..... H04R 3/007 381/55

* cited by examiner

LOUDSPEAKER CONE EXCURSION ESTIMATION USING REFERENCE SIGNAL

FIELD

The present description pertains to the field of loudspeakers and, in particular, to estimating the excursion of a loudspeaker cone using a reference signal.

BACKGROUND

In and electrodynamic loudspeaker, a cone is attached to a voice coil. The voice coil is moved by an electromagnet powered by an audio amplifier. The faster and farther the cone moves, the louder the sound from the loudspeaker. In today's mobile devices, very small loudspeakers are used in order to allow for thinner and smaller devices. Smaller loudspeakers are desired for many devices in order to reduce size and to require less power to drive the loudspeakers. At the same time, mobile devices such as mobile phones and tablet computers are typically designed to reproduce acoustic signals with high loudness.

The very small loudspeakers used in mobile phones and tablets are called micro speakers. Due to their small size, their performance is limited. The total volume and contrast are both low. As a result, these loudspeakers are often operated close to the boundary of their safe operating range.

Any electrodynamic loudspeaker is vulnerable to damage by overly large excursions of the voice coil and the cone. Typical failures are caused by the voice coil hitting the back plate or the cone suspension being torn due to excessive forward force. The loudspeakers are protected by limiting the overall amplifier power. This allows for safe operation of micro speakers with a safe distance from the boundary of the loudspeaker's safe operating area.

BRIEF DESCRIPTION OF THE DRAWINGS

Embodiments are illustrated by way of example, and not by way of limitation, in the figures of the accompanying drawings in which like reference numerals refer to similar elements.

DETAILED DESCRIPTION

As described herein, the excursion of a loudspeaker voice coil or cone may be estimated. The estimate may then be applied to protect the loudspeaker. The terms "cone excursion" and "voice coil excursion" will be used interchangeably herein. Since the two are typically attached either one may be measured. However, even if not directly attached one may be used to estimate the other. As described herein, either or both excursions may be estimated.

The loudspeaker voice coil excursion is estimated based on the gain compression of a small signal that is applied to the voice coil. The gain compression is caused by nonlinearities in the loudspeaker's response to an input signal. The estimate may be used to actively monitor the voice coil excursion and reduce the input power whenever necessary. This allows the loudspeaker to be driven closer to its limits, providing more volume and dynamic range. This loudspeaker protection scheme may be used to adapt loudspeaker input power dependent on the maximum excursion present at any one time.

Two non-linear effects present in electrodynamic speakers may be used to estimate excursion. These effects cause the electrical-to-mechanical speaker transfer function to exhibit saturation effects at high excursions. In terms of small signal transfer characteristics, the small signal gain of the electrical-to-mechanical speaker transfer function is compressed in the presence of large amplitude excursion. When a (small signal) reference signal or pilot tone is superposed onto a (possibly large signal) electrical acoustic audio signal, the small signal gain compression in the speaker causes an acoustic representation of the pilot which is modulated by the amplitude of the large signal.

In a speaker protection system, the acoustic output of the cone can be picked up using a microphone and typical interface circuitry. From the received signal, the received reference can be isolated and demodulated to determine the gain compression. The gain compression may be used to estimate the voice coil excursion. This may be done using hardware components, such as a microphone, analog to digital interface, and audio DSP, that are already integrated in a mobile device or using specific dedicated components.

Figure 1:
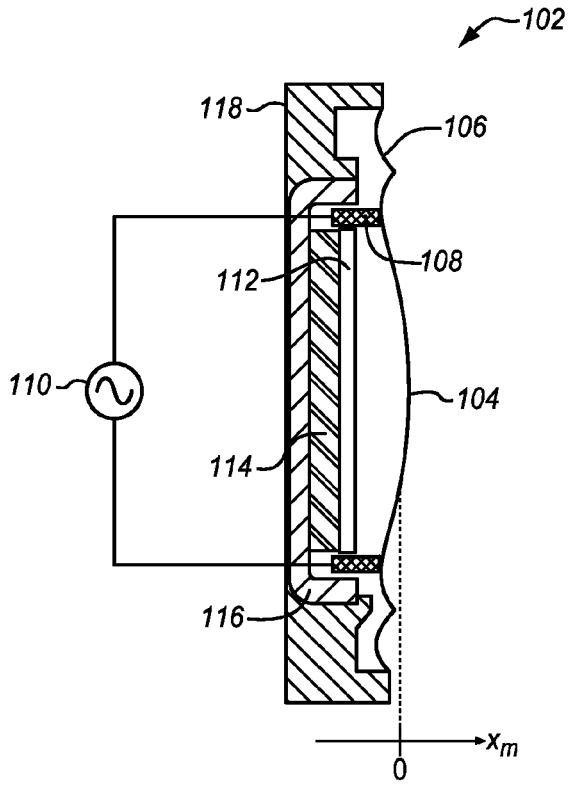
FIG. 1 is a cross-sectional side view diagram of a micro speaker according to an embodiment.

FIG. 1 is a cross-sectional side view of a micro speaker of type commonly used for small mobile devices such as cell phones and tablets. The electro-mechanical behavior of such a driver as well as a conventional larger dynamic driver may be modeled using an equivalent circuit (not shown). The electrodynamic driver is constructed in a frame or cage 118 which holds all of the parts. The driver features a typically rectangular cone 104 held in place by a surrounding peripheral rectangular suspension 106 that is attached to the frame. Alternatively, the cone may be circular with a surrounding concentric circular suspension or any of a variety of other shapes, depending on the particular implementation. The cone is attached to a floating voice coil 108 which moves the cone in and out or left and right as shown in the diagram. This movement of the cone generates a compression wave through the surrounding air which provides the acoustic signal.

An electrical audio signal 110 is generated by an amplifier and applied to the voice coil (an electromagnet) 108. In interaction with the magnetic field generated by the (permanent) magnet 114, the electrical signal results in an electromagnetic force to move the cone 104. The driver may also have iron or other ferric elements 112, 116 to enhance the effect of the electromagnet on the voice coil.

The electrodynamic loudspeaker acts as a transducer from the applied electrical audio signal to the acoustic compression wave in the air. The behavior of the transducer is subject to many effects, caused by the physical characteristics and configurations of the materials, the housings, the magnets, and the device in which the loudspeaker is housed. In addition to impedance, reactance, and limits in the transfer function, there are also higher-order effects such as thermal behavior, eddy currents, radiation impedance, acoustic speaker box properties, cone break-up modes, etc.

The electrical input terminal 110 on the left is used to supply the loudspeaker with a voltage $v_e(t)$ and a current $i_e(t)$. The current $i_e(t)$ is transduced to a mechanical force $F_m(t)=Bl \cdot i_e(t)$ by the motor composed of the magnet 114, the iron cores 112, 116, and the voice coil 108. The transduction factor is also affected by inductance, resistance, and capacitance in the voice coil motor. The actual excursion of the cone is related to this force but is not linearly related except near the center of the cone's travel range. The movement of the cone $x_m(s)$ in response to the applied force is affected by the mass of the cone 104 and connected voice coil 108, the damping caused by the suspension 106, and various friction losses from the suspension and the surrounding air.

The relationship between the input current and the cone excursion is not linear. Many causes for non-linearities in loudspeakers exist which cause a variety of different effects. One such effect is that the motor force $F_m$ is dependent on the cone excursion $x_m$, therefore the force factor Bl is a function of the cone excursion. This can be explained in part by the design of the voice coil motor. At high excursions, part of the voice coil leaves the gap of the magnetic circuit. In other words, the voice coil 108 moves away from the magnetic field of the magnet 114. The voice coil is then surrounded by a weaker magnetic field. This reduces the driving force to accelerate the cone.

Figure 2:
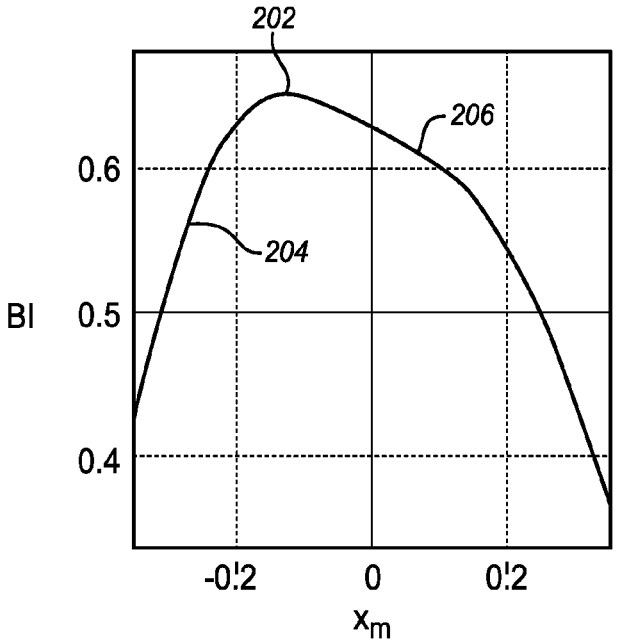
FIG. 2 is a graph of a force factor of the voice coil motor of the micro speaker of FIG. 1 according to an embodiment.

This effect is illustrated in FIG. 2 a graph of the force factor Bl of the voice coil motor as determined by the input current on the vertical axis against cone excursion $x_m$ on the horizontal axis. This graph shows actual results obtained using a common micro speaker. As shown, the force factor has a peak 202 near the center of the cone's travel. As the cone moves toward the frame or away from the frame the force factor is reduced. These larger excursions correspond to higher audio volumes. The higher force factor shows that the loudspeaker is much more efficient at lower volumes. There is something like an inflection point 204 at the near end of the cone excursion at about −0.25 as the force factor drops off more precipitously. Similarly there is another point at the far end of the cone excursion at about +0.1 where the slope changes and the force factor reduces much quickly with changes in excursion. This effect means that it requires a higher input current to obtain the same increase in cone movement as the cone movement increases.

Another effect is that the cone suspension 106 is made from viscoelastic materials. As the suspension reaches the limit of its travel in either direction, its resistance to movement increases. At high positive or negative excursions, the suspension gradually reaches a physical limit beyond which it cannot stretch. In other words, the suspension has a compliance which decreases for large excursions.

Figure 3:
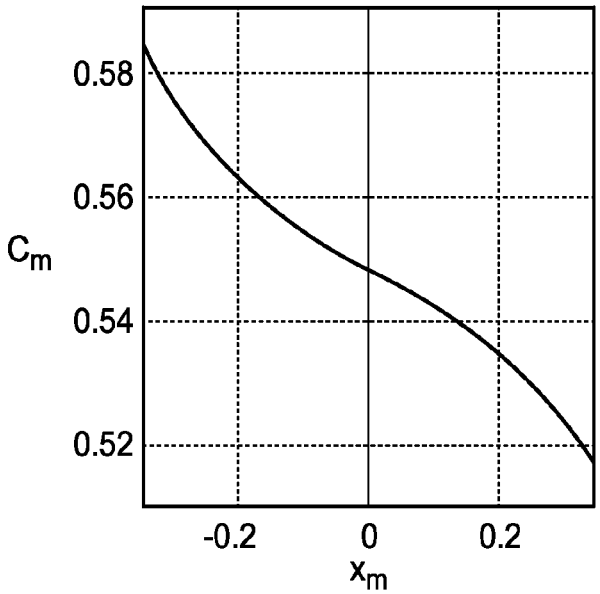
FIG. 3 is a graph of the compliance of the micro speaker cone of FIG. 1 according to an embodiment.

This effect is illustrated in FIG. 3 a graph of the compliance $C_m$ of the loudspeaker cone on the vertical axis vs. excursion $x_m$ of the cone on the horizontal axis. This graph shows actual results obtained using a common micro speaker. As shown for positions near the frame the compliance increases geometrically. There is an asymptotic limit to the cone's excursion which is just past the low end of the horizontal scale. Similarly, the compliance reduces geographically at the high end of the horizontal scale and asymptotically approaches a maximum limit of excursion. These results reflect that the suspension system imposes an absolute limit on cone travel in order to hold the cone in place.

Figure 4:
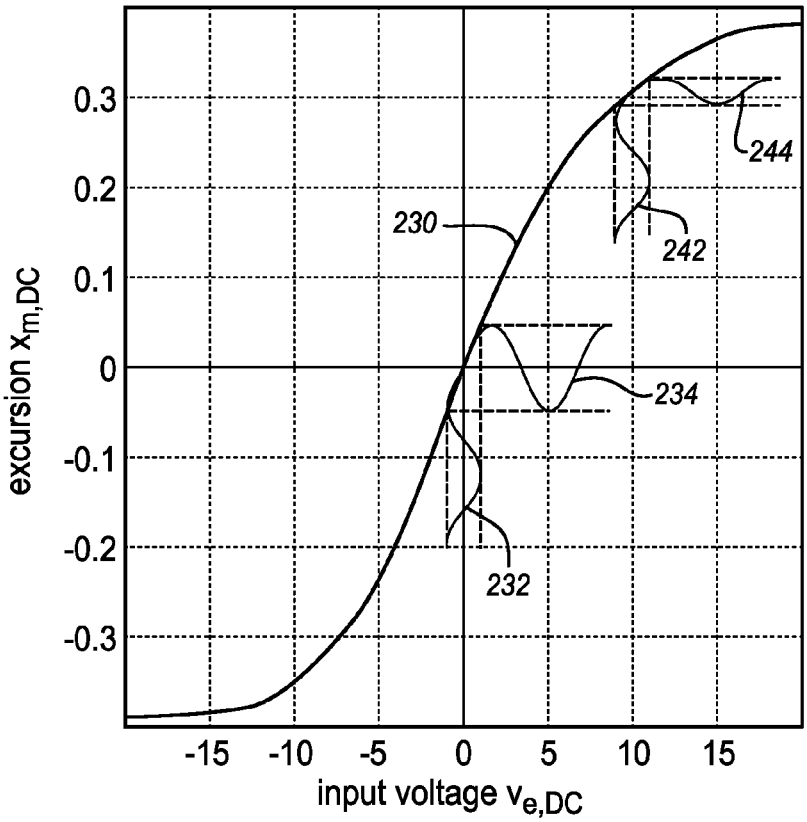
FIG. 4 is a graph of the excursion of the micro speaker cone of FIG. 1 according to an embodiment.

These effects, among others, mean that the gain for a small signal is reduced at high cone excursions due to the decreasing force factor $Bl(x_m)$ and compliance $C_m(x_m)$. Small signals are reproduced with lower volume when there is high cone excursion than when there is low cone excursion. FIG. 4 visualizes these relations using the actual response measured using a micro speaker. The input voltage for a large DC (Direct Current) signal is shown on the horizontal axis against the actual cone excursion on the vertical axis.

The DC signal drives the cone to a particular position with respect to the loudspeaker frame and the magnet. At two different positions an AC (Alternating Current) reference signal is applied. A first reference signal 232 is applied to the cone when there is no DC input voltage, i.e. the input DC voltage is 0 as shown in FIG. 4. The AC reference signal 232 results in a cone excursion 234 from −0.05 to +0.05 as shown on the graph, thus having a high peak-to-peak value of 0.10.

A second AC reference signal 242 with the same curve and voltages is applied to the loudspeaker tone when there is an input DC voltage of +10. At this DC input voltage, the cone has an excursion of +0.31. The same AC signal applied at this excursion causes a much smaller cone excursion from about +0.3 to +0.32, thus having a low peak-to-peak value of 0.02. As shown by the cone excursion curve 230 caused by the DC signal, the cone has a far smaller excursion response at 10 volts than at 0 volts. This is reflected in the response to the small AC pilot signal.

The terms reference signal and pilot tone are both used herein to refer to the same signal. The signal is used as a reference to determine cone excursion or a related quantity. The term "pilot tone signal" might be construed as meaning that the signal is composed of just one single sinusoidal signal (i.e. one discrete frequency). However, the pilot tone signal is not so limited. A single frequency may be used or a more complex signal may be used. The reference signal may have a broader, continuous or varying spectrum (e.g. a chirp signal).

This phenomenon is used, as described herein, to estimate the absolute cone excursion and detect situations in which the speaker is close to its physical limits. When such a situation is detected, the applied electrical drive signal may be adjusted to ensure the safety of the speaker. This allows the speaker to be driven closer to its limits than would be possible without being able to detect such a situation.

Figure 5:
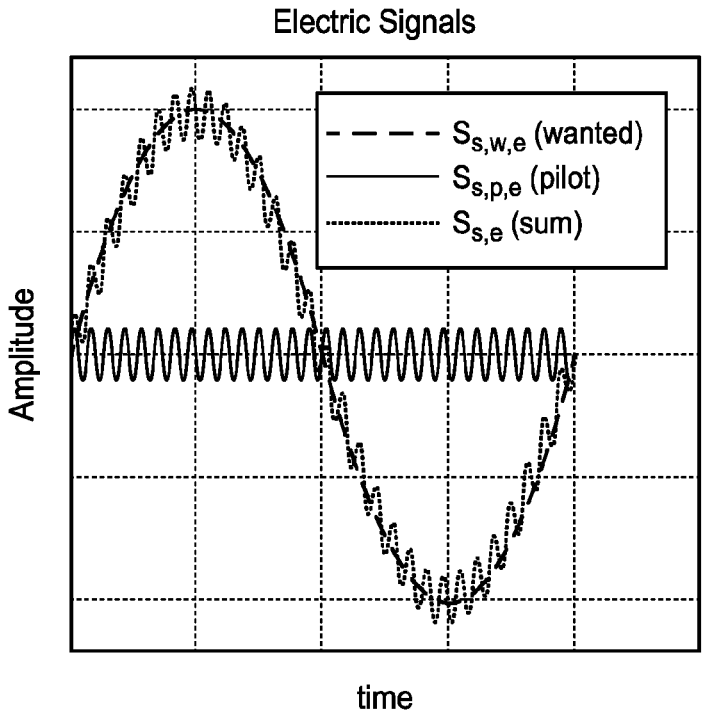
FIG. 5 is a graph of input electrical signals for a micro speaker according to an embodiment.

FIG. 5 is a graph of input electrical signals that may be used in a limits detection process. The electrical signals are shown with amplitude on the vertical axis over time on the horizontal axis. An input signal $s_{s,e}(t)$ is applied to the electrical drive connections of the electrodynamic loudspeaker voice coil. The combined signal has the wanted audio electrical signal $s_{s,w,e}(t)$, and electrical pilot tones or reference signals $s_{s,p,e}(t)$ superimposed on the electrical wanted signal. The reference signal's amplitude as shown has a much lower amplitude. This may be selected to result in a low mechanical excursion amplitude to avoid unnecessary utilization of the speaker's capabilities. The reference signal may also be selected so that it does not significantly increase the total cone excursion. The reference signal may also be selected so that the resulting audio signal is not audible to a human listener. This may be done by making the amplitude very low, the frequency very high or both.

Figure 6:
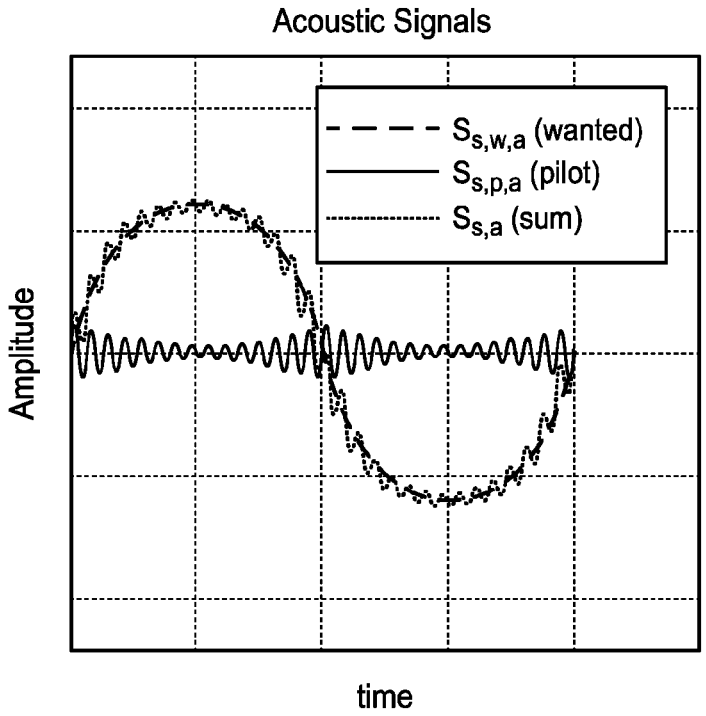
FIG. 6 is a graph of output acoustic signals of a micro speaker according to an embodiment.

FIG. 6 shows acoustic signals that may be produced by the speaker cone in response to the input electrical signals of FIG. 5. The amplitude is shown on the vertical axis versus time on the horizontal axis. As shown the wanted audio signal from the speaker is identified as $s_{s,w,a}(t)$. The higher amplitude of the wanted signal leads to declinations of the motor force factor $Bl(x_m)$ and the suspension compliance $C_m(x_m)$. As a result, the reference signal $s_{s,p,a}(t)$ will be reproduced at a lower amplitude because the small signal gain of the electro-acoustical transfer function is lowered. As illustrated in FIG. 6, the acoustic reference signal signal is amplitude modulated by the wanted acoustic signal. In other words, when the large amplitude reaches a high or low peak, the amplitude of the pilot signal is diminished. A superimposed reference signal is used here for illustration purposes only. A similar result may be obtained, for example, using parts of the wanted signal spectrum as a reference signal.

Figure 7:
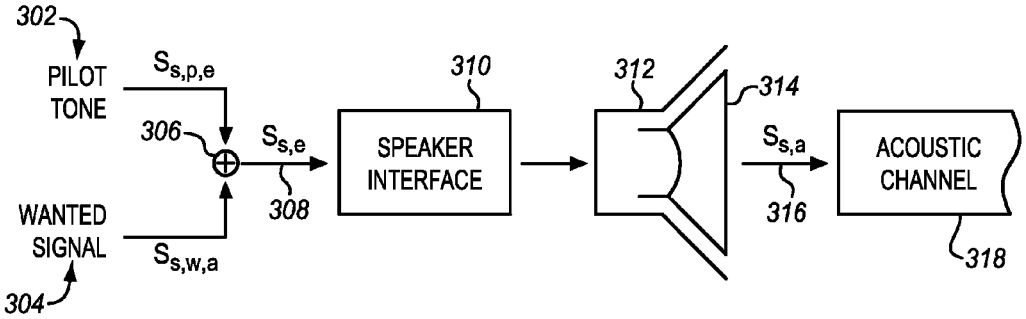
FIG. 7 is a diagram of an electrodynamic speaker system using a pilot tone according to an embodiment.

FIG. 7 is a diagram of an electrodynamic loudspeaker system to provide a physical context for the signals of FIGS. 5 and 6. The reference signal $s_{s,p,e}$ is created at a signal generator 302 including an amplifier and the wanted signal, such as voice or music, $s_{s,w,e}$ is produced by a signal generator 304. Both signals are applied to a combiner 306 which produces the combined electrical drive signal $s_{s,e}$ 308. The combined signal 308 is applied to a speaker interface 310 which may include a crossover network, equalizer, high and low pass filters, impedance limiters, amplifiers and other components. The interface 310 applies the processed signal to the speaker driver 312 which drives the speaker cone 314 to produce an output analog acoustic pressure wave signal $s_{s,a}$ 316. The acoustic or audio signal is coupled into an acoustic channel in the ambient air surrounding the system for analysis as described below.

Figure 8:
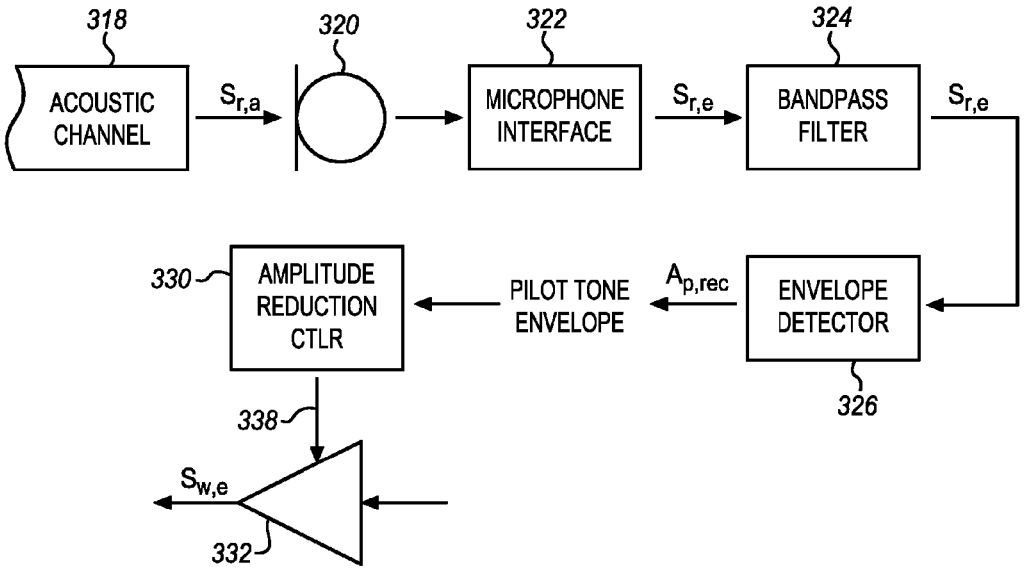
FIG. 8 is a diagram of a microphone audio receive system for receiving a pilot tone according to an embodiment.

The resulting acoustic signal 316 may be further processed and demodulated. FIG. 8 shows a receive chain for the acoustic signal 316 as it is received from the acoustic channel 318. The acoustic signal now referred to as $s_{r,a}\cdot(t)$ is received by a microphone 320 and converted from an acoustic compression wave to an electrical analog signal. The acoustic signal $s_{r,a}(t)$ is converted to an electrical signal $s_{r,e}(t)$ using corresponding microphone interface circuitry 322 such as an amplifier Analog to Digital converter, etc. Next a bandpass filter 324 takes the digitized signal and extracts the reference signal and its modulation components $s_{r,p,e}(t)$ from the received signal $s_{r,e}(t)$. If the reference signal is outside of the frequency range of the wanted signal, then it may be the dominant sound in that range and can easily be extracted using a bandpass filter that passes only the frequencies near the reference signal.

In embodiments, the wanted signal is restricted to a particular frequency range which may be the audible range or, more likely, a smaller range than the audible range. The reference signal may be placed outside the range of the wanted signal to allow the bandpass filter to eliminate the wanted signal. If the reference signal is outside the audible range, then it will not be heard by users, eliminating any distraction or annoyance. Micro speakers as shown and many other loudspeakers are capable of producing ultrasonic sounds. While many loudspeakers are only able to produce ultrasonic sounds at much lower efficiency and maximum volume, a lower volume and lower efficiency audio output may well be suitable for the current purposes.

Finally, the reference signal envelope may be detected by means of an envelope detector 326. This provides the reference signal envelope $A_{p,rec}$. As described above and shown in FIGS. 5 and 6, the reference signal envelope is related to the cone excursion caused by the wanted signal which is supplied to the speaker. The reference signal envelope may be applied to an amplitude reduction controller 332. This may operate in a variety of different ways to control the amplitude of the wanted signal $s_{s,w,e}(t)$. In one example the amplitude reduction controller is a part of an overall speaker protection system. This system may be implemented using an audio controller, a central processor, or a simpler analog or digital signal processing system.

In one example, the speaker protection system has a stored threshold for the maximum allowed reduction of the received reference signal envelope. If the reduction in the envelope exceeds the threshold, then a control signal is produced to reduce the power supplied to the speaker. This is shown as a control signal 338 to an amplifier 332 that amplifies the wanted electrical signal. The system may use a first threshold for a reduction in the positive side of the reference signal envelope and a second threshold for a reduction in the negative side of the envelope. This accommodate any possible asymmetry in the transduction function as shown in FIG. 2. The power reduction may be provided in different ways and in different parts of the audio signal chain, from the original source audio to the loudspeaker circuitry. The illustrated amplifier may be positioned directly before the loudspeaker or in any place in a digital or analog audio signal chain. The protection system may operate to reduce the amplification or to attenuate a signal after it is amplified.

Figure 9:
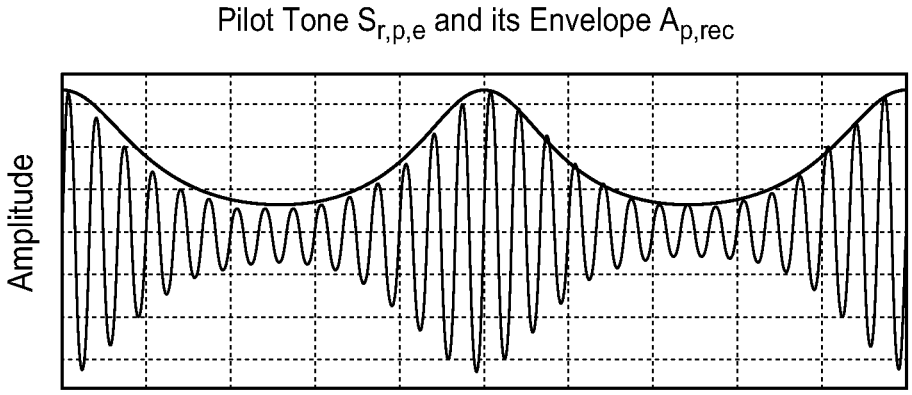
FIG. 9 is a graph of a received pilot tone and its signal envelope according to an embodiment.

FIG. 9 is a graph of the reference signal as an example based on multiple cycles of the analog output signals of FIG. 6. The reference signal is illustrated as amplitude on the vertical axis versus time on the horizontal axis. The input reference signal as shown in FIG. 5 has a constant amplitude. After being transduced by the loudspeaker cone 314 into the acoustic channel 318, captured by the microphone 320 and bandpass filtered 324, the modulation of the pilot signal 402 caused by the primary or wanted signal can be seen. The envelope detector 326 extracts the envelope 404 of the signal which provides only the amplitude variations caused by the primary signal.

Figure 10:
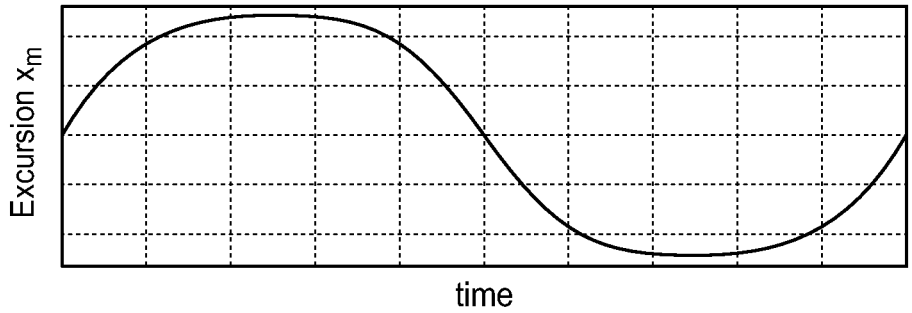
FIG. 10 is a graph of cone excursion for the pilot tone signal of FIG. 9 according to an embodiment.
Figure 11:
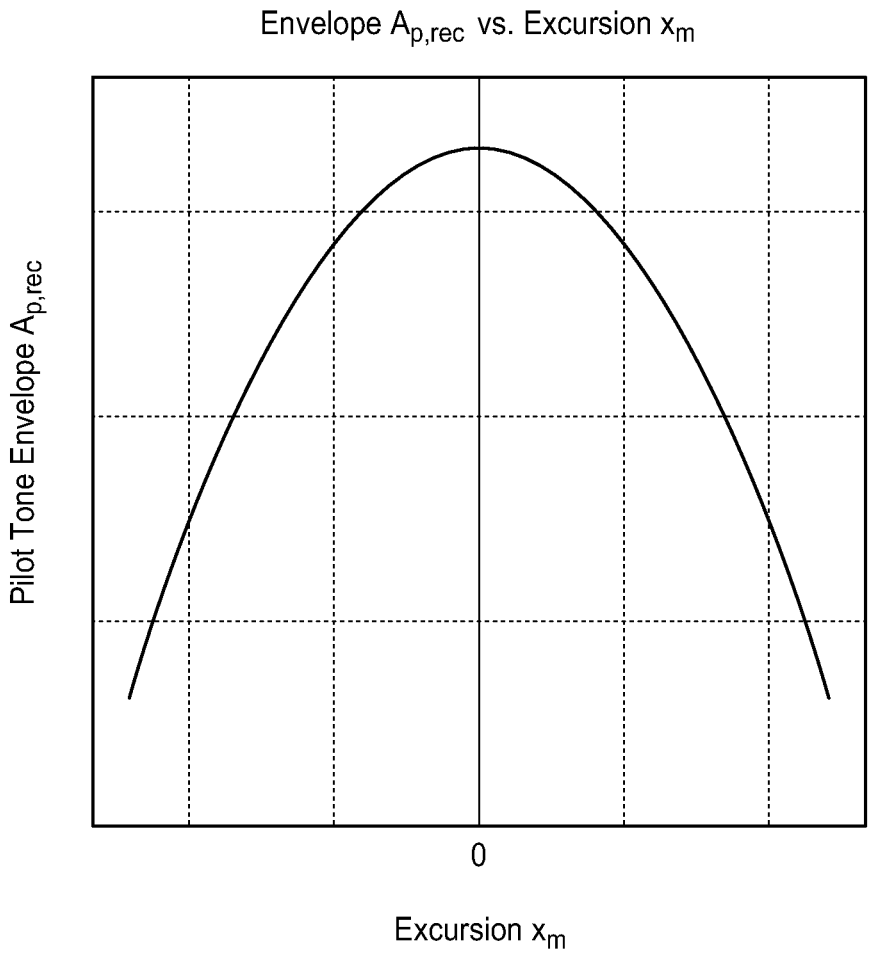
FIG. 11 is a graph of the envelope of FIG. 9 versus the cone excursion of FIG. 10 according to an embodiment.

FIG. 10 is a diagram of the loudspeaker cone excursion in distance on the vertical axis versus time. The timeline is aligned with FIG. 9. Here the envelope can be related directly to the cone excursion. As a result, the minimum reference signal amplitude 408 is mapped directly to the maximum cone excursion 406. The maximum reference signal amplitude 412 occurs at the minimum cone excursion 410. These results may be combined as in FIG. 11 to show the reference signal envelope maximum on the vertical axis versus the cone excursion. In the graph of FIG. 11, the smallest excursion is at zero and movement to the left or right of the zero mark represents an increase in excursion. As shown, the reference signal amplitude decreases with excursion. This allows the cone excursion to be estimated using the reference signal attenuation. The specific parameters of this function connecting the reference signal attenuation to cone excursion may vary with different loudspeaker designs, materials, and construction methods but can be readily characterized empirically.

The data represented by the graph of FIG. 11 may be used to select thresholds for the amplitude reduction controller 330. The amount of reference signal attenuation may be compared to one or more thresholds to trigger a reduction in the amplitude of the applied primary or wanted audio signal $s_{s,w,e}(t)$. With multiple thresholds, the applied reduction measures may be made more extreme as the reference signal attenuation increases. Alternatively, a mapping function or look-up table may be used to determine an attenuation value for different amounts of envelope amplitude attenuation.

As described, the cone excursion may be determined using components that are already present in many types of portable devices, such as microphones, audio signal processing, and amplifier control circuits. This is more compact and less expensive than adding some additional physical means to directly determine loudspeaker cone excursion such as a laser rangefinder, an accelerometer on the cone, or a secondary magnetic system with another winding integrated into the loudspeaker. The secondary winding may also introduce other secondary effects that reduce the quality of the sound produced by the loudspeaker cone.

Figure 12:
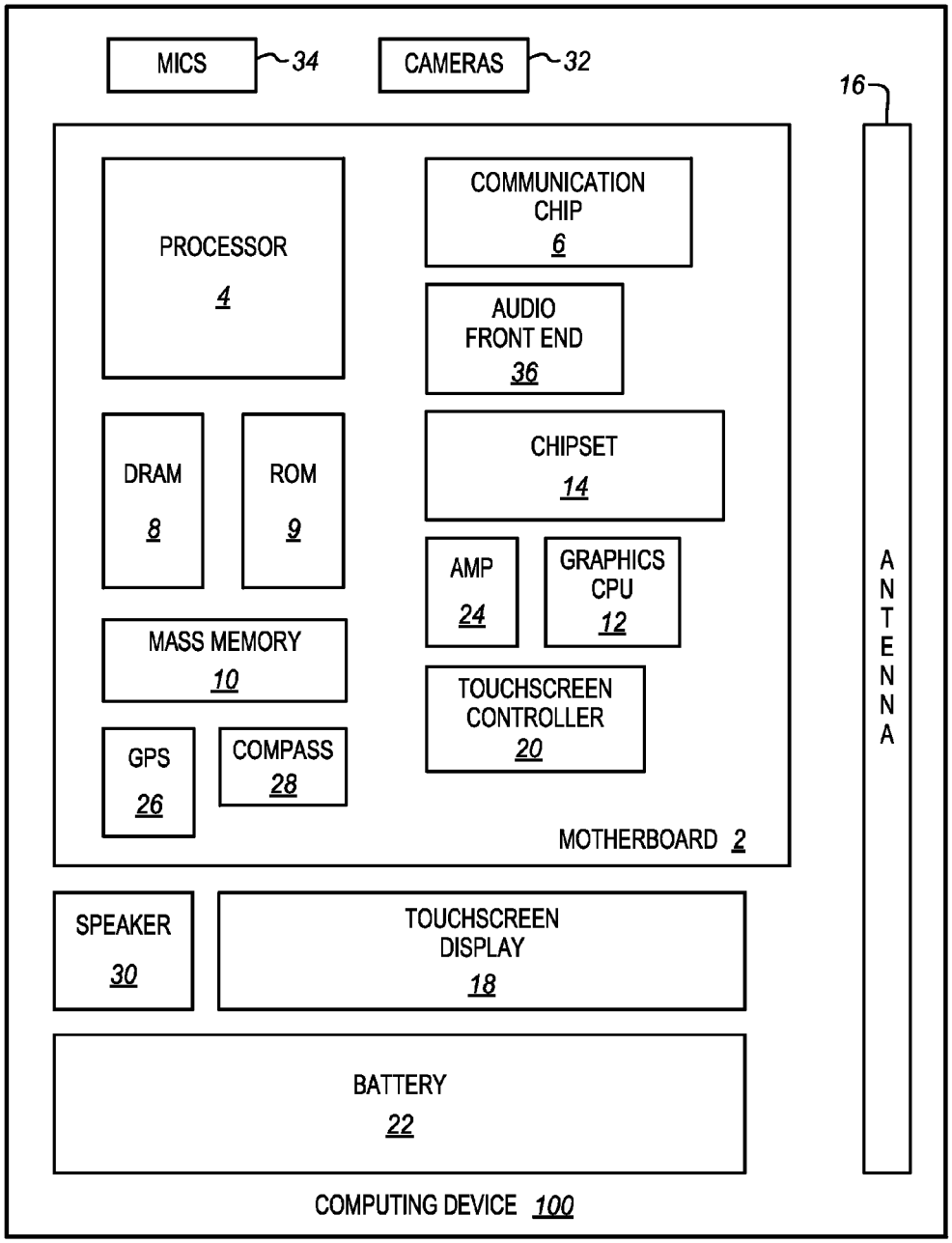
FIG. 12 is a block diagram of a computing device incorporating speech enhancement according to an embodiment.

FIG. 12 is a block diagram of a computing device 100 in accordance with one implementation. The computing device 100 houses a system board 2. The board 2 may include a number of components, including but not limited to a processor 4 and at least one communication package 6. The communication package is coupled to one or more antennas 16. The processor 4 is physically and electrically coupled to the board 2.

Depending on its applications, computing device 100 may include other components that may or may not be physically and electrically coupled to the board 2. These other components include, but are not limited to, volatile memory (e.g., DRAM) 8, non-volatile memory (e.g., ROM) 9, flash memory (not shown), a graphics processor 12, a digital signal processor (not shown), a crypto processor (not shown), a chipset 14, an antenna 16, a display 18 such as a touchscreen display, a touchscreen controller 20, a battery 22, an audio codec (not shown), a video codec (not shown), a power amplifier 24, a global positioning system (GPS) device 26, a compass 28, an accelerometer (not shown), a gyroscope (not shown), a speaker 30, a camera 32, a microphone array 34, and a mass storage device (such as hard disk drive) 10, compact disk (CD) (not shown), digital versatile disk (DVD) (not shown), and so forth). These components may be connected to the system board 2, mounted to the system board, or combined with any of the other components.

The communication package 6 enables wireless and/or wired communications for the transfer of data to and from the computing device 100. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication package 6 may implement any of a number of wireless or wired standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, Ethernet derivatives thereof, as well as any other wireless and wired protocols that are designated as 3G, 4G, 5G, and beyond. The computing device 100 may include a plurality of communication packages 6. For instance, a first communication package 6 may be dedicated to shorter range wireless communications such as Wi-Fi and Bluetooth and a second communication package 6 may be dedicated to longer range wireless communications such as GPS, EDGE, GPRS, CDMA, WiMAX, LTE, Ev-DO, and others.

The microphones 34 and the speaker 30 are coupled to an audio front end 36 to perform digital conversion, signal insertion, extraction, analysis, and adjustment as described herein. The processor 4 is coupled to the audio front end to drive the process with interrupts, to set parameters, and to control operations of the audio front end.

In various implementations, the computing device 100 may be eyewear, a laptop, a netbook, a notebook, an ultrabook, a smartphone, a tablet, a personal digital assistant (PDA), an ultra mobile PC, a mobile phone, a desktop computer, a server, a set-top box, an entertainment control unit, a digital camera, a portable music player, or a digital video recorder. The computing device may be fixed, portable, or wearable. In further implementations, the computing device 100 may be any other electronic device that processes data.

Embodiments may be implemented as a part of one or more memory chips, controllers, CPUs (Central Processing Unit), microchips or integrated circuits interconnected using a motherboard, an application specific integrated circuit (ASIC), and/or a field programmable gate array (FPGA).

References to "one embodiment", "an embodiment", "example embodiment", "various embodiments", etc., indicate that the embodiment(s) so described may include particular features, structures, or characteristics, but not every embodiment necessarily includes the particular features, structures, or characteristics. Further, some embodiments may have some, all, or none of the features described for other embodiments.

In the following description and claims, the term "coupled" along with its derivatives, may be used. "Coupled" is used to indicate that two or more elements co-operate or interact with each other, but they may or may not have intervening physical or electrical components between them.

As used in the claims, unless otherwise specified, the use of the ordinal adjectives "first", "second", "third", etc., to describe a common element, merely indicate that different instances of like elements are being referred to, and are not intended to imply that the elements so described must be in a given sequence, either temporally, spatially, in ranking, or in any other manner.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

The following examples pertain to further embodiments. The various features of the different embodiments may be variously combined with some features included and others excluded to suit a variety of different applications. Some embodiments pertain to a method that includes receiving a primary signal produced by a cone of a loudspeaker, the primary signal causing an excursion of the loudspeaker cone, receiving a reference signal produced simultaneously with the primary signal by the loudspeaker cone, the reference signal causing an excursion of the loudspeaker cone that is amplitude modulated by the excursion caused by the primary signal, determining an amplitude modulation of the reference signal, and determining an excursion of the loudspeaker cone using the determined amplitude modulation.

Further embodiments include reducing the amplitude of the primary signal in response to the estimated excursion.

In further embodiments determining an amplitude modulation comprises determining an amplitude attenuation of the reference signal the method further comprising reducing the amplitude of the primary signal when the amplitude attenuation exceeds a threshold.

In further embodiments determining an amplitude attenuation comprises detecting an amplitude envelope of the reference signal and determining a minimum of the amplitude envelope.

In further embodiments the reference signal is caused by an electrical reference signal provided to the loudspeaker and wherein the electrical reference signal has a constant amplitude.

In further embodiments the reference signal is caused by an electrical reference signal provided to the loudspeaker and wherein the electrical reference signal has a varying frequency.

In further embodiments the reference signal is outside of an audible frequency band and wherein the primary signal is within the audible frequency band.

Further embodiments include band pass filtering the reference signal to remove the primary signal before analyzing the reference signal.

In further embodiments receiving is performed at a microphone of a device in a housing and wherein the loudspeaker is a component of the device in the same housing.

In further embodiments the primary signal is caused by an electrical primary signal provided to the loudspeaker and wherein reducing the amplitude of the primary signal comprises reducing the amplitude of the electrical primary signal.

In further embodiments estimating the excursion comprises applying the amplitude modulation of the reference signal to a mapping function to determine the loudspeaker cone excursion caused by the amplitude of the primary signal.

Some embodiments pertain to an apparatus that includes a loudspeaker having a cone to produce audio, a microphone to receive a primary signal produced by the loudspeaker cone simultaneously with a reference signal produced by the loudspeaker cone, the reference signal causing an excursion of the loudspeaker cone that is amplitude modulated by the excursion caused by the primary signal, and a processor to determine an amplitude modulation of the reference signal and determine an excursion of the loudspeaker cone using the determined amplitude modulation.

In further embodiments and determining an excursion comprises determining an amplitude attenuation of the reference signal and mapping the determined amplitude attenuation to determine the excursion.

In further embodiments determining an excursion comprises determining an amplitude attenuation of the reference signal and comparing the attenuation to one or more thresholds.

In further embodiments determining an amplitude modulation comprises detecting an amplitude envelope of the reference signal and determining a minimum of the amplitude envelope.

In further embodiments the primary signal is caused by an electrical primary signal, the apparatus further comprising an amplifier to amplify the electrical primary signal and a controller coupled to the amplifier to reduce the amplitude of the electrical primary signal in response to the estimated excursion.

Further embodiments include a band pass filter to remove the primary signal before determining an amplitude modulation of the reference signal.

Some embodiments pertain to a computing system that includes a loudspeaker having a cone to produce audio, a microphone to receive a primary signal produced by the loudspeaker cone simultaneously with a reference signal produced by the loudspeaker cone, the reference signal causing an excursion of the loudspeaker cone that is amplitude modulated by the excursion caused by the primary signal, and a processor to determine an amplitude modulation of the reference signal and determine an excursion of the loudspeaker cone using the determined amplitude modulation, and a controller to reduce the amplitude of the primary signal in response to the estimated excursion.

In further embodiments the processor is further to determine an amplitude attenuation of the reference signal from the determined modulation and to compare the attenuation to one or more thresholds, and wherein the controller reduces the amplitude of the primary signal in response to the comparison.

Further embodiments include a pilot tone signal generator to provide a constant amplitude signal to the loudspeaker to cause the reference signal to be produced by the loudspeaker.

What is claimed is:

1. A method comprising:

receiving a primary acoustic signal produced by a cone of a loudspeaker in response to a primary signal, the primary signal causing an excursion of the loudspeaker cone;

receiving a reference acoustic signal produced simultaneously with the primary signal by the loudspeaker cone in response to a reference signal, the reference signal causing an excursion of the loudspeaker cone that is amplitude modulated by the excursion caused by the primary signal;

determining an amplitude modulation of the reference acoustic signal; and determining an excursion of the loudspeaker cone using the determined amplitude modulation.

2. The method of claim 1, further comprising reducing the amplitude of the primary signal in response to the estimated excursion.

3. The method of claim 2, wherein determining an amplitude modulation comprises determining an amplitude attenuation of the reference acoustic signal the method further comprising reducing the amplitude of the primary signal when the amplitude attenuation exceeds a threshold.

4. The method of claim 3, wherein determining an amplitude attenuation comprises detecting an amplitude envelope of the reference acoustic signal and determining a minimum of the amplitude envelope.

5. The method of claim 1, wherein the reference acoustic signal is caused by an electrical reference signal provided to the loudspeaker and wherein the electrical reference signal has a constant amplitude.

6. The method of claim 1, wherein the reference acoustic signal is caused by an electrical reference signal provided to the loudspeaker and wherein the electrical reference signal has a varying frequency.

7. The method of claim 1, wherein the reference signal is outside of an audible frequency band and wherein the primary signal is within the audible frequency band.

8. The method of claim 1, further comprising band pass filtering the reference acoustic signal to remove the primary signal before analyzing the reference signal.

9. The method of claim 1, wherein receiving is performed at a microphone of a device in a housing and wherein the loudspeaker is a component of the device in the same housing.

10. The method of claim 2, wherein the primary acoustic signal is caused by an electrical primary signal provided to the loudspeaker and wherein reducing the amplitude of the primary signal comprises reducing the amplitude of the electrical primary signal.

11. The method of claim 1, wherein estimating the excursion comprises applying the amplitude modulation of the reference signal to a mapping function to determine the loudspeaker cone excursion caused by the amplitude of the primary acoustic signal.

12. An apparatus comprising:

a loudspeaker having a cone to produce audio;

a microphone to receive a primary acoustic signal produced by the loudspeaker cone in response to a primary signal simultaneously with a reference acoustic signal produced by the loudspeaker cone in response to a reference signal, the reference signal causing an excursion of the loudspeaker cone that is amplitude modulated by the excursion caused by the primary signal; and a processor to determine an amplitude modulation of the reference acoustic signal and determine an excursion of the loudspeaker cone using the determined amplitude modulation.

13. The apparatus of claim 12, wherein determining an excursion comprises determining an amplitude attenuation of the reference acoustic signal and mapping the determined amplitude attenuation to determine the excursion.

14. The apparatus of claim 12, wherein determining an excursion comprises determining an amplitude attenuation of the reference acoustic signal and comparing the attenuation to one or more thresholds.

15. The apparatus of claim 12, wherein determining an amplitude modulation comprises detecting an amplitude envelope of the reference acoustic signal and determining a minimum of the amplitude envelope.

16. The apparatus of claim 12, wherein the primary acoustic signal is caused by an electrical primary signal, the apparatus further comprising an amplifier to amplify the electrical primary signal and a controller coupled to the amplifier to reduce the amplitude of the electrical primary signal in response to the estimated excursion.

17. The apparatus of claim 12, further comprising a band pass filter to remove the primary acoustic signal before determining an amplitude modulation of the reference acoustic signal.

18. A computing system comprising:

a loudspeaker having a cone to produce audio;

a microphone to receive a primary acoustic signal produced by the loudspeaker cone in response to a primary signal simultaneously with a reference acoustic signal produced by the loudspeaker cone in response to a reference signal, the reference signal causing an excursion of the loudspeaker cone that is amplitude modulated by the excursion caused by the primary signal; and a processor to determine an amplitude modulation of the reference acoustic signal and determine an excursion of the loudspeaker cone using the determined amplitude modulation; and a controller to reduce the amplitude of the primary signal in response to the estimated excursion.

19. The system of claim 18, wherein the processor is further to determine an amplitude attenuation of the reference acoustic signal from the determined modulation and to compare the attenuation to one or more thresholds, and wherein the controller reduces the amplitude of the primary signal in response to the comparison.

20. The system of claim 18, further comprising a pilot tone signal generator to provide a constant amplitude signal to the loudspeaker to cause the reference acoustic signal to be produced by the loudspeaker.

* * * * *